United States Patent [19]

Knapp

[11] Patent Number: 4,662,567

[45] Date of Patent: May 5, 1987

[54] ELECTROMAGNETICALLY ACTUATABLE VALVE

[75] Inventor: Heinrich Knapp, Leonberg, Fed. Rep. of Germany

[73] Assignee: Robert Bosch GmbH, Stuttgart, Fed. Rep. of Germany

[21] Appl. No.: 788,288

[22] Filed: Oct. 17, 1985

[30] Foreign Application Priority Data

Dec. 13, 1984 [DE] Fed. Rep. of Germany ..... 3445405

[51] Int. Cl.[4] ..... B05B 1/32

[52] U.S. Cl. ..... 239/585; 251/129.18; 251/129.21

[58] Field of Search ..... 239/585; 251/129.14, 251/129.17, 129.18, 129.21

[56] References Cited

U.S. PATENT DOCUMENTS

| | | | |
|---|---|---|---|
| 1,822,668 | 9/1931 | Protzeller | 251/129.18 |
| 3,738,387 | 6/1973 | Ingram et al. | 251/129.14 X |
| 4,030,668 | 6/1977 | Kiwior | 239/585 |
| 4,179,069 | 12/1979 | Knapp et al. | 239/585 |
| 4,230,273 | 10/1980 | Claxton et al. | 239/585 X |
| 4,365,747 | 12/1982 | Knapp et al. | 239/585 X |
| 4,403,741 | 9/1983 | Moriya et al. | 239/585 |
| 4,423,843 | 1/1984 | Palma | 239/585 |
| 4,494,701 | 1/1985 | Hensley et al. | 239/585 |
| 4,575,009 | 3/1986 | Giraudi | 239/585 |

FOREIGN PATENT DOCUMENTS

| | | | |
|---|---|---|---|
| 3244290 | 6/1983 | Fed. Rep. of Germany . | |
| 2039993 | 8/1980 | United Kingdom | 239/585 |

*Primary Examiner*—Andres Kashnikow
*Assistant Examiner*—Mary Beth O. Jones
*Attorney, Agent, or Firm*—Edwin E. Greigg

[57] ABSTRACT

An electromagnetically actuatable valve is proposed, which serves in particular to inject fuel into the intake tube of internal combustion engines operating with fuel injection systems. The fuel injection valve includes a valve housing, a core, a magnetic coil and a cylindrical armature which is connected via a rod-like connecting part having a smaller cross section than the armature with a valve closing member embodied in the form of a ball. The valve closing member cooperates with a valve seat provided in a valve seat body. The radial guidance of the armature is effected by a narrow annular disk. The valve closing member is radially guided only by the valve seat in its closed position and by a stop in its open position. Downstream of the valve seat fuel guide bores lead into a preparation bore in the form of a blind bore, which has a diameter of approximately 1 mm.

5 Claims, 1 Drawing Figure

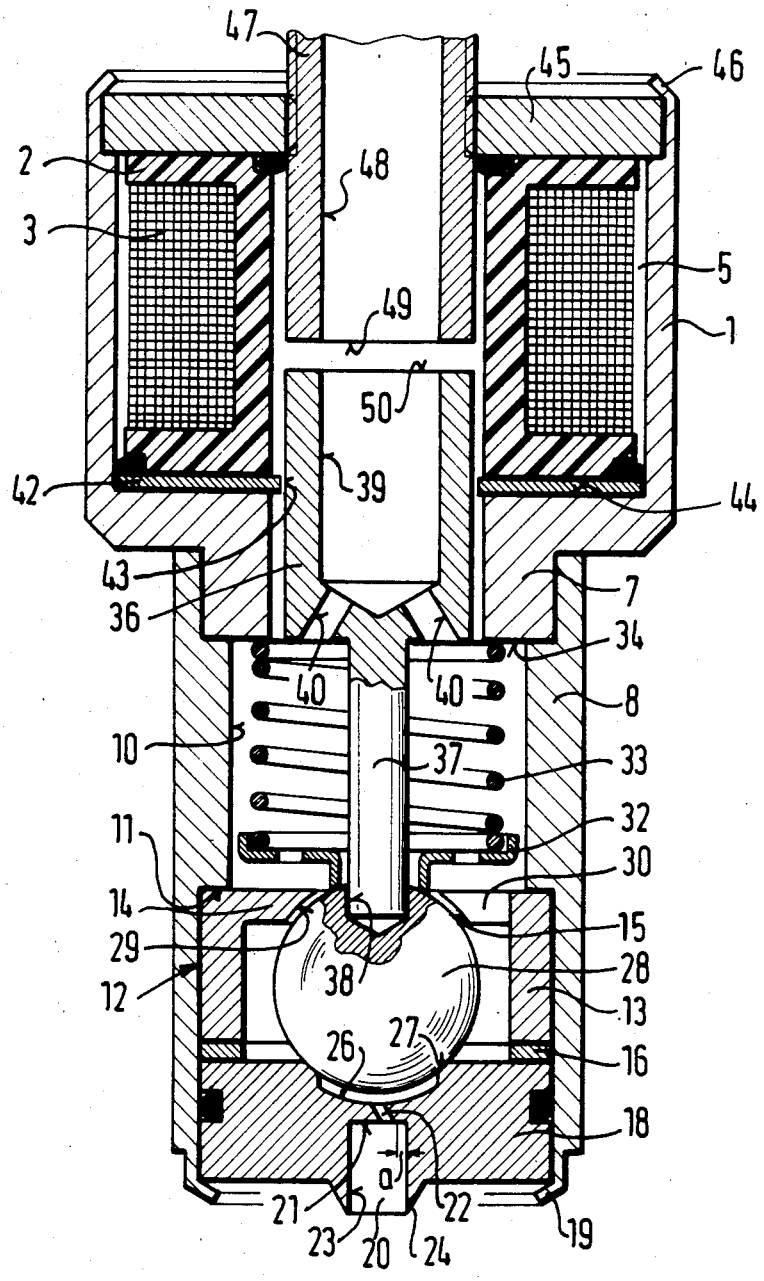
47
45
46
2
48
3
5
49
1
50
42
39
44
43
7
36
34
40
40
8
10
37
33
11
32
30
14
15
29
38
28
12
13
26
27
16
18
a
21
22
23
20
24
19

ELECTROMAGNETICALLY ACTUATABLE VALVE

BACKGROUND OF THE INVENTION

The invention is based on an electromagnetically actuatable valve as generally defined hereinafter. A valve of this kind is already known, which has the advantage of a low mass on the part of the valve closing member; however, its response speed is decreased by the friction between a guide bore and the connecting part, and the stroke is limited by the contact of the armature on the core; to avoid magnetic sticking, a nonmagnetic disk must be placed between the armature and the core, and to prevent the abutting surfaces from damaging one another, they must have great impact strength.

OBJECT AND SUMMARY OF THE INVENTION

The valve according to the invention has the advantage over the prior art in that it operates very fast; has small dimensions; that its dynamic and static flow quantity can be adjusted easily and accurately; that it assures good fuel preparation; and also that it can be installed easily. The static flow quantity can be adjusted even before the entire valve is assembled, by varying the spacing between the valve seat body and the stop; also, the valve closing member, which is movable back and forth between its end positions at the valve seat and at the stop without requiring guidance of its circumference, simultaneously serves to rest on the stop in order to limit the stroke.

In a particularly advantageous embodiment of the invention, the preparation bore is embodied with a small diameter, of approximately 1 mm, resulting in a very small surface area on its cylinder wall that is wetted with fuel; thus virtually no residual fuel remains behind in the preparation bore between the various opening positions of the valve.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing is a simplified cross-sectional representation of an exemplary embodiment of the invention.

DESCRIPTION OF THE PREFERRED EMBODIMENT

The fuel injection valve shown in the drawing for a fuel injection system of a mixture-compressing, externally ignited internal combustion engine has a valve housing 1 of ferromagnetic material, in which a magnetic coil 3 is disposed on a coil carrier 2. The magnetic coil 3 has a supply of electric current via a plug connection, not shown. The cup-shaped valve housing 1 is adapted to receive the magnetic coil 3 in a coil chamber 5 and has a plug extension 7 which points outwardly, and onto which a mouthpiece 8 which is tightly joined with the plug extension 7 is fitted. The tubular mouthpiece 8 has a stepped bore 10, on the step 11 of which a stop 12 rests, and this stop 12 has a cylindrical portion 13 and a perpendicular portion 14 joined to the cylindrical portion 13 and arranged to rest on the step 11. The perpendicular portion 14 extends radially into the interior of the stepped bore 10 and has a stop opening 15. Remote from the perpendicular portion 14 and adapted to rest on the cylindrical portion 13 is a spacer disk 16, which is adjoined by a valve seat body 18, that is encompassed by a crimped rim 19 of the mouthpiece 8. This crimped rim thus keeps the valve seat body 18, together with the spacer disk 16 and the stop 12, clamped in the axial direction. The valve seat body 18 has a preparation bore 20 embodied as a blind bore, and into the bore bottom 21 of which at least one fuel guide bore 22 discharges. This fuel guide bore 22 throttles the fuel and thus serves as a means of fuel metering. The fuel guide bore 22 preferably discharges at the bore bottom 21, at a radial distance a from the cylinder wall 23 of the preparation bore 20, in such a manner that a tangential flow into the preparation bore 20 does not take place; instead, the fuel stream initially emerges from the fuel guide bores 22 without touching the wall, and then strikes the cylinder wall 23 of the preparation bore 20, becoming distributed there in the form of a film and flowing in this way toward a valve seat body end 24, which is embodied as much like a knife-edge as possible. The fuel guide bores 22 extend at an inclination with respect to the longitudinal axis of the valve, and they begin at a curved chamber 26 embodied in the valve seat body. Further, a curved valve seat 27 is embodied on the valve seat body 18 upstream of the curved chamber 26, and a ball-shaped valve closing member 28 cooperates with the curved valve seat 27. In order to attain the smallest possible idle volume, the volume of the curved chamber 26 should be as small as possible when the valve closing member 28 is seated on the valve seat 27. Preferably the diameter of the preparation bore 20 is also kept quite small and is in the range of approximately 1 mm, resulting in only a small surface wetted by fuel on the cylinder wall 23 of the preparation bore 20, so that hardly any residual fuel remains behind between the various open positions of the valve.

The stop face 29 on the perpendicular portion 14 that defines the stop opening 15 partially encompasses and is spaced apart from the surface of the valve closing member remote from the valve seat 27, when the valve closing member 28 is resting on the valve seat 27, and is either inclined or curved with respect to the longitudinal axis of the valve. Flow openings 30 enable an unhindered flow of fuel around the valve closing member 28 at the perpendicular portion 14. The valve closing member 28 thus serves not only as a means for controlling the valve seat 27, but also, by resting on the stop face 29 of the perpendicular portion 14, serves as a stroke limiting means as well. Also, the valve closing member 28, which is provided with a hard surface, cooperates with the likewise hard stop face 29, without there being any necessity to make any demands whatever upon these parts in terms of their magnetic properties.

In this embodiment, the static fuel flow quantity of the valve can be adjusted outside the mounted valve; because of the selection of the diameter of the throttling fuel guide bores 22, a pressure drop of approximately 90% takes place, while approximately 10% of the pressure drop occurs between the valve seat 27 and the valve closing member 28. To this end, the openning stroke of the valve closing member until it rests on the stop face 29 is adjusted by suitably selecting the thickness of the spacer disk 16. Once the necessary thickness of the spacer disk 16 is ascertained, this spacer disk 16 can be inserted in between the stop 12 and the valve seat body 18, and the entire combination of the stop 12, spacer disk 16 and valve seat body 18 can be introduced into the stepped bore 10 and fixed by means of the crimped rim 19. A radial guidance of the valve closing member 28 is effected solely in its end positions when it rests on the valve seat 27 and on the stop face 29, while between these two end positions the valve closing member 28 is freely movable, without lateral guidance.

Remote from the valve seat 27, a spring support plate 32 is disposed on the valve closing member 28 and is engaged by a compression spring 33, the other end of which rests for instance on the end face 34 of the plug extension 7. The spring support plate 32 extends partially through the stop opening 15 of the perpendicular portion 14 and engages the valve closing member 28. Accordingly, the spring support plate 32 is capable of transmitting only slight lateral forces of the compression spring 33 to the valve closing member 28.

The cylindrically embodied armature 36 which extends into the stepped bore 10 further includes a rod-like connecting part 37. The cross section of the rod-like connecting part is substantially reduced in comparison with the cross section of the armature 36 and as shown in the drawing it is adapted to engage a securing bore 38 of the valve closing member 28, and in which bore it is joined to the valve closing member 28, for instance by laser welding. A bore 39 is provided in the armature 36 in an axial direction remote from the connecting part 37. This bore 39, as shown, is open, and on its end oriented toward the connecting part 37 it has outflow conduits 40 toward the stepped bore 10. Accordingly, the tubular armature 36, the rod-like connecting part 37 and the ball-like valve closing member 28 together have a very small mass that has to be moved. The diameter of the valve closing member 28 preferably does not exceed 3 mm, and the diameter of the armature 36 is selected to be still smaller than that. The result is a very slender structure for the valve; in particular, the diameter of the mouthpiece 8 may be in the range of 8 mm, while the length of the mouthpiece 8 and of the connecting part 37 in the axial direction is selected in accordance with space required for installation on the intake tube or cylinder of the engine.

The radial guidance of the armature 36 is effected by a narrow annular disk 42, which is provided with a guide opening 43 so that the armature 36 can pass therethrough with little play. The disk 42 rests on the bottom 44 of the valve housing 1 and is axially clamped via the coil carrier 2, which is acted upon by a cover 45, which is disposed on the end of the valve housing 1 remote from the bottom 44 and is fixed in its position by a crimped edge 46 of the valve housing 1. A core 47 is supported in the cover 45 such that it is axially movable, for instance being screwed in place; at the same time this core 47 serves as a fuel feed pipe and has a fuel bore 48 which is open toward the armature as well as the interior of the valve. The dynamic fuel quantity can be adjusted by rotating or displacing the core 47 and hence by varying the residual air gap between the core end face 49 and the armature end face 50, without the core end face 49 and the armature end face 50 having to serve as stop faces.

The magnetic circuit between the core 47 and the armature 36 is closed via the cover 45, the valve housing 1 and the annular disk 42, and a definite radial gap for the magnetic circuit is formed between the annular disk 42 and the armature 36.

Any small contact surfaces between the wall of the guide opening 43 of the annular disk 42 and the jacket of the armature 36 result in only very slight friction, so that making the low mass of the armature 36, the connecting part 37 and the valve closing member 28 into account as well, the result is a very fast-acting valve. The armature 36 and the core 47 can be fabricated from high-grade soft-magnetic material, because they need not be provided with hard surfaces for performing a stop function. The valve closing member 28 already has a hard surface, so that in order to provide a stop, only the stop face 29 needs to be treated and given a sufficient hardness. By means of the annular disk 42, a very economical and simple guidance of the armature 36 can be attained.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An electromagnetically actuatable fuel injection valve, for fuel injection systems of internal combustion engines, comprising a valve housing having a linear axis, a core, a magnetic coil and a cylindrical armature radially guided by an annular disk, said armature being rigidly connected via a rod-like connecting part to a spherical valve closing member, said spherical valve closing member cooperates with a valve seat formed by an axially disposed valve seat body, said valve closing member being guided in its closing position by said rod-like connecting part and by said valve seat and in its open position during excitation of said magnetic coil by a stop means with a curved end surface substantially the same curvature of said valve closing member which limits an upward stroke movement of said valve closing member and further wherein said valve closing member is urged in a closing direction by a closing force of a closing spring seated on a spring plate means having an end surface with the curvature of said spherical valve closing member seated on a surface of said valve closing member juxtaposed said stop means.

2. A valve as defined by claim 1 which includes a spacer disk disposed between one end of said stop means and one end of said valve seat body wherein said stroke of said valve closing member may be varied by use of different sized spacer disk.

3. A valve as defined by claim 1, further wherein said core and said armature each have spaced opposed end faces which spacing therebetween in a nonexcited condition is variable by moving said core relative to said armature.

4. A valve as defined by claim 1, further wherein said valve seat body includes fuel guide bores which are inclined with respect to said axis of said valve seat body, each said fuel guide bore have a discharge opening adapted to discharge into a preparation bore having a bottom, said preparation bore having a diameter of approximately 1 mm, and said discharge opening being spaced apart radially a distance a from a cylinder wall of said preparation bore.

5. A valve as claimed in claim 1 wherein said end surface of said spring plate and said valve seat are spherical-shaped sections.

* * * * *